US011846211B2

(12) United States Patent
Sharma et al.

(10) Patent No.: US 11,846,211 B2
(45) Date of Patent: Dec. 19, 2023

(54) HLA ARRANGEMENT USING COLD FORMED PLUNGER AND MANUFACTURING SIMPLIFICATIONS

(71) Applicant: Eaton Intelligent Power Limited, Dublin (IE)

(72) Inventors: Mahima Sharma, New Delhi (IN); Vikram Deokar, Pune (IN); Advait Ashokrao Patil, Pune (IN); Akash Rajendra Shinde, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 26 days.

(21) Appl. No.: 17/627,956

(22) PCT Filed: Jul. 17, 2020

(86) PCT No.: PCT/EP2020/025335
§ 371 (c)(1),
(2) Date: Jan. 18, 2022

(87) PCT Pub. No.: WO2021/008734
PCT Pub. Date: Jan. 21, 2021

(65) Prior Publication Data

US 2022/0290586 A1 Sep. 15, 2022

(30) Foreign Application Priority Data

Jul. 18, 2019 (IN) ..... 201911028970
Jan. 8, 2020 (IN) ..... 202011000870

(51) Int. Cl.
*F01L 1/24* (2006.01)
*F01L 1/18* (2006.01)

(52) U.S. Cl.
CPC ..... *F01L 1/2411* (2013.01); *F01L 1/181* (2013.01); *F01L 2001/187* (2013.01); *F01L 2001/2444* (2013.01); *F01L 2303/00* (2020.05)

(58) Field of Classification Search
CPC ... F01L 1/181; F01L 2001/187; F01L 1/2411; F01L 2001/2444; F01L 2303/00
(Continued)

(56) References Cited

U.S. PATENT DOCUMENTS 5,706,771 A * 1/1998 Van Heyningen ..... F01L 1/46 123/90.46
5,709,181 A * 1/1998 Williams ..... F01L 1/2411 123/90.46
(Continued)

FOREIGN PATENT DOCUMENTS

DE 19509052 A1 2/1996
DE 19505406 A1 * 8/1996 ..... F01L 1/2411
(Continued)

OTHER PUBLICATIONS

International Search Report and Written Opinion for PCT/EP2020/025335; dated Oct. 27, 2020; pp. 1-9.

*Primary Examiner* — Jorge L Leon, Jr.
(74) *Attorney, Agent, or Firm* — Baker Botts L.L.P.

(57) ABSTRACT

A retainer clip can be used to restrict travel of a hydraulic lash adjuster body relative to a plunger of a hydraulic lash adjuster. A seating depth of the hydraulic lash adjuster can be controlled via a plunger cup in a hydraulic lash adjuster bore. The plunger cup can also restrict purge of lash oil from the hydraulic lash adjuster bore. A rocker arm can comprise a rocker arm body comprising a force-receiving end, a valve end, and a rocker shaft bore. An extension can connect the rocker shaft bore to the valve end. A hydraulic lash adjuster bore can be in the valve end. A plunger cup or an end socket
(Continued)

profile can be included in the hydraulic lash adjuster bore for receiving a plunger of a hydraulic lash adjuster.

16 Claims, 6 Drawing Sheets

(58) Field of Classification Search
USPC ..... 123/90.46
See application file for complete search history.

(56) References Cited

U.S. PATENT DOCUMENTS

| | | | | |
|---|---|---|---|---|
| 5,901,676 | A | 5/1999 | Edelmayer | |
| 8,555,842 | B2 | 10/2013 | Janowiak | |
| 2008/0190391 | A1 | 8/2008 | Mcelwee et al. | |
| 2011/0271924 | A1* | 11/2011 | Heinemann ..... | F01L 1/185 123/90.52 |
| 2011/0277715 | A1 | 11/2011 | Janowiak | |

FOREIGN PATENT DOCUMENTS

| | | | |
|---|---|---|---|
| DE | 19515434 | A1 | 10/1996 |
| DE | 102005059701 | A1 | 6/2007 |
| DE | 102008010130 | A1 | 9/2008 |
| EP | 0899429 | A1 | 3/1999 |
| EP | 2386730 | A1 | 11/2011 |
| EP | 2662541 | A1 | 11/2013 |
| GB | 2138093 | A | 10/1984 |
| JP | S6181510 | A | 4/1986 |

* cited by examiner

HLA ARRANGEMENT USING COLD FORMED PLUNGER AND MANUFACTURING SIMPLIFICATIONS

This is a United States § 371 National Stage Application of PCT/EP2020/025335 filed Jul. 17, 2020 and claims the benefit of Indian provisional patent application 201911028970 filed Jul. 18, 2019 and claims the benefit of Indian provisional patent application 202011000870 filed Jan. 8, 2020 which are incorporated herein by reference.

FIELD

This application provides a rocker arm assembly comprising a hydraulic lash adjuster bore, an end socket profile or plunger cup, and a hydraulic lash adjuster.

BACKGROUND

Lash adjustment can be done manually in valvetrains. However, this requires periodic servicing events. The lash much be reset to keep up with wear and tear over time.

Hydraulic lash adjusters can have a high part count and complex manufacture. When installed in a rocker arm, manufacture to add hydraulic ports must also be considered.

SUMMARY

The methods and devices disclosed herein overcome the above disadvantages and improves the art by way of a rocker arm providing hydraulic lash adjustment, a rocker arm designed for receiving a hydraulic lash adjuster, and an improved hydraulic lash adjuster.

A hydraulic lash adjuster provides dynamic fluid control of the engine lash. It can keep up with wear and tear more dynamically than mechanical lash adjusters and thereby require fewer servicing events. So, it is desired to add hydraulic lash adjustment at least to type V valvetrains. Preferably, both type III and type V valvetrains.

A hydraulic lash adjuster as disclosed herein has a reduced part count. Manufacturing steps to the rocker arm are also simplified, improving cost-competitiveness with mechanical lash adjusters.

A retainer clip as disclosed herein can be left in place after a hydraulic lash adjuster has been installed in a rocker arm. The retainer clip can serve as a travel limit to prevent sponginess, pump-up, and pump-down of a hydraulic lash adjuster.

A retainer clip can be used to restrict travel of a hydraulic lash adjuster body relative to a plunger of a hydraulic lash adjuster. A seating depth of the hydraulic lash adjuster can be controlled via a plunger cup in a hydraulic lash adjuster bore. The plunger cup can also restrict purge of lash oil from the hydraulic lash adjuster bore. A rocker arm can comprise a rocker arm body comprising a force-receiving end, a valve end, and a rocker shaft bore. An extension can connect the rocker shaft bore to the valve end. A hydraulic lash adjuster bore can be in the valve end. A plunger cup or an end socket profile can be included in the hydraulic lash adjuster bore for receiving a plunger of a hydraulic lash adjuster.

The hydraulic lash adjuster can comprise a plunger with a convex spherical end and the plunger cup can comprise a concave shape to receive the convex spherical end of the plunger. Additionally, the plunger cup can comprise a purging hole aligned with the plunger.

The rocker arm can comprise a fluid pathway from the rocker shaft bore, through the hydraulic lash adjuster bore, and out of the valve end of the rocker arm. The plunger cup can be sized so as to block the fluid pathway out of the valve end of the rocker arm. Alternatively, the plunger cup can be sized to permit purging of lash oil out of a path of the fluid pathway.

The rocker arm and the hydraulic lash adjuster can comprise a first convex spherical end on a plunger seated against the plunger cup or end socket profile. And, a second convex spherical end can be formed on a hydraulic lash adjuster body configured to seat against a valve stem end or against an elephant foot. The hydraulic lash adjuster body can cup the plunger.

The plunger can be cold formed or roll formed to form a one-piece plunger of the integrally-formed same material.

The hydraulic lash adjuster, and hence the rocker arm, can comprise a lash assembly seated to bias the hydraulic lash adjuster body away from the plunger. A circlip or retainer clip can be configured restrict travel of the hydraulic lash adjuster body. A reservoir volume of lash fluid can be retained in a cavity of the plunger and a swept volume of lash fluid can be retained in the hydraulic lash adjuster body.

A retainer clip can comprise an arcuate clip body, an exterior extension in the internal groove, and an internally-projecting nose seated in the supply port. Then, the hydraulic lash adjuster, and hence the rocker arm, can comprise the retainer clip. Then, a plunger comprising a supply port can be seated against the plunger cup or the end socket profile. A hydraulic lash adjuster body can cup the plunger and can comprise an internal groove. A lash assembly can be seated to bias the hydraulic lash adjuster body away from the plunger. Then, the retainer clip can be seated in the internal groove and in the supply port, and the retainer clip can be configured to restrict travel of the hydraulic lash adjuster body relative to the plunger.

The retainer clip can comprise an arcuate clip body, an exterior extension in the internal groove, and an internally-projecting nose seated in the supply port. The clip body can comprise an upper end and a lower end, and the lower end can be sandwiched between the hydraulic lash adjuster body and the plunger.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1:
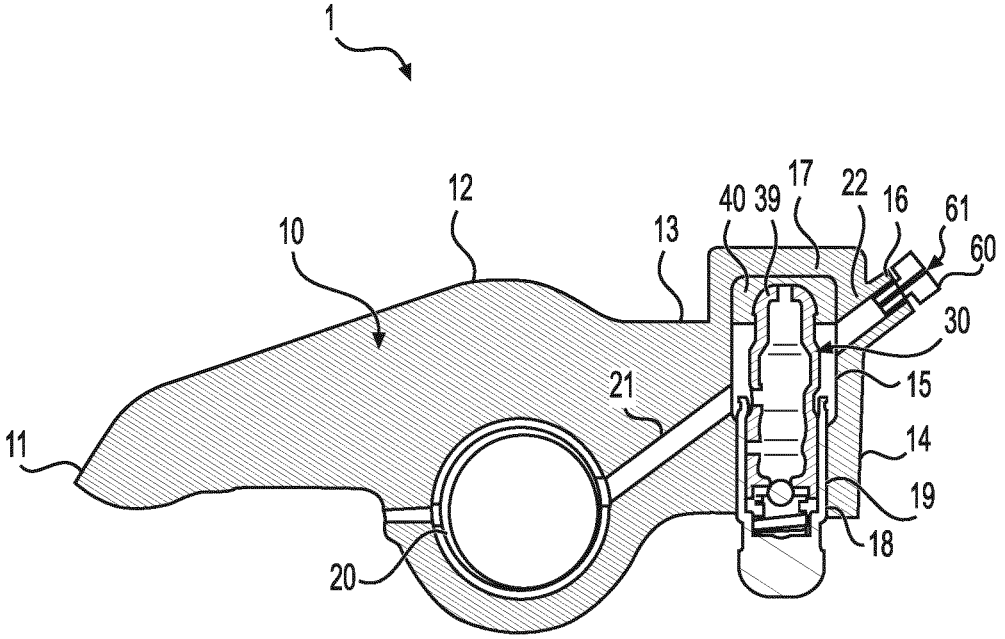
FIG. 1 is a cross-section view of a first rocker arm assembly.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

A type V engine can comprise a rocker arm 10 connected to a valve stem 90 on one end and connected to a push tube on a force-receiving end 11. A rotating cam can impart a lift profile to the push tube and the rocker arm 10 can rock and impart the lift profile to the valve. A hydraulic lash adjuster ("HLA") 30, 301 can be connected to the rocker arm 10, in this instance installed within an inner diameter 19, 191 of an HLA bore 15, 151 in the valve end 14, 141 of the rocker arm 10. The HLA 30, 301 can be of the "Euro Clip" type. The HLA bore 15, 151 can be straight machined or formed during casting or forging, among others, such as machining. The rocker arm 10 can be configured according to any of the rocker arm assemblies 1-5 shown in FIGS. 1-4. The proposed arrangement is simplified and is cost competitive.

FIG. 1 shows a first rocker arm assembly 1. The rocker arm 10 can comprise a body 12 that can be forged or cast, among others. A rocker bush 20 can be seated in a rocker shaft bore in a central section of the body. A force-receiving end 11 can be on one side of the rocker shaft bore. A valve end 14 can be on a second side of the rocker shaft bore at the end of an extension 13.

An oil gallery can be connected to the rocker bush 20. An oil control valve (OCV) can be coupled to a rocker shaft. A fluid pathway in the rocker shaft could connect to one or more glands in the rocker bush 20 to supply fluid within the rocker arm 10. Fluid pathways can be drilled or tooled in the forged or cast rocker arm 10, among others. The fluid pathways can comprise an optional path to lubricate the force-receiving end 11 and a supply path 21 through the extension 13 to provide fluid to the HLA bore 15, 151. A tip 16, 161 can be formed on the valve end 14, 141. The fluid pathways can comprise a supply path 21, 221 connected to a path 22, 212. Supply path 21, 211 can be cross drilled by forming path 22, 212 through the tip 16, 161, extending across the HLA bore 15, 151, and drilling through the extension 13 to reach the rocker shaft bore. Of great cost savings, the tolerance for the precision of the drilling can be reduced because of the plunger cup 40, 45 and end socket profile 172 improvements disclosed herein. As discussed herein below, the plunger cup 40, 45 can be designed to extend beyond path 22, 212 to block it, or plunger cup 40, 45 can be designed so that it does not block the path 22, 212 or only partially blocks the path. Other fluid pathways, such as externally-mounted or injection-style, can be used with the alternative lightweighting, circlip, retainer clip, and travel limit features disclosed herein.

The HLA bore 15, 151 can be formed in a cylindrical shape with optional steps in the inner diameter 19, 191. A socket end 17, 171 can be formed as a travel limit in the HLA bore 15. By hollowing out the HLA bore 15, 151, the rocker arm 10 can be of light weight. It can be advantageous to remove more material from the HLA bore 15 than the volume occupied by the HLA 30, 301. Then, a plunger cup 40, 45 can be inserted to customize the seated position of the HLA 30, 301. Or, it is possible to machine excess material past the socket end 171 to set the depth of the HLA 30, 301 in the HLA bore 151.

The plunger cup 40, 45 can comprise a plunger cup body 41 that can be shaped to press fit against the socket end 17 and against the inner diameter 19 of the HLA bore 15. Alternatively, the plunger cup 40, 45 can be threaded within the HLA bore 15, offering an alternative or additional means to set the depth of the HLA 30, 301 in the HLA bore 15. The HLA 30, 301 can seat against a ball-type socket 43 in the plunger cup body 41. The socket can be rounded and concave to accept the concave portion of the spherical end 39, 391 of the HLA 30, 301. Plunger cup 40, 45 can be sized for several purposes, such as setting the depth at which the HLA 30, 301 is placed in the HLA bore 15. This can allow the same rocker arm 10 to be used in multiple valvetrains with the HLA 30, 301 set to a depth custom for the valve stem length or other cylinder head parameter. By comparing plunger cups 40 & 45, it can be seen that the length of the plunger cup body 41 can be selected for custom purposes, also.

The length of the plunger cup body 41 can be chosen to maintain light weighting. FIG. 1 shows a light plunger cup 40 that can be designed so that it does not completely block path 22. Then, a plug 60 can be placed in path 22. A controlled orifice, also called a purging hole 61 can be included in the plug 60 to control an amount of lash oil purged from the HLA bore 15.

Figure 2A:
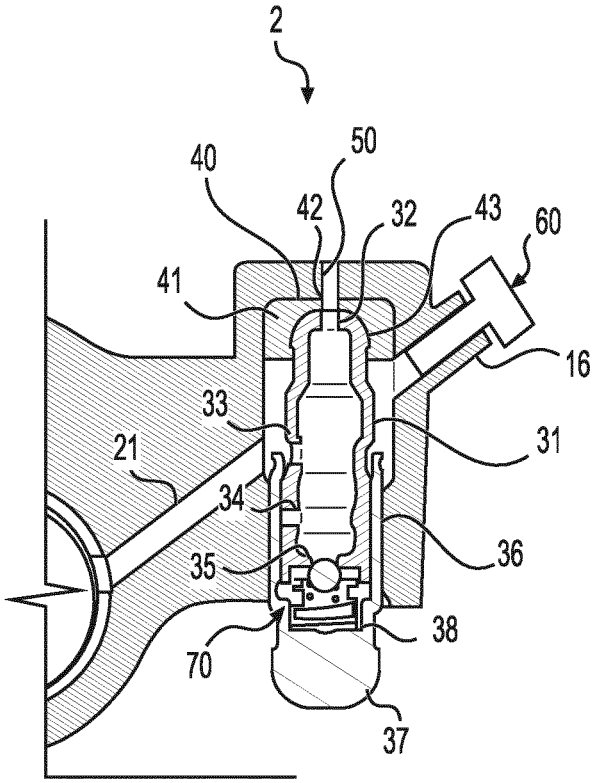
FIGS. 2A-2C are views to explain variants of a second rocker arm assembly and variant hydraulic lash adjusters (HLAs).
Figure 2B:
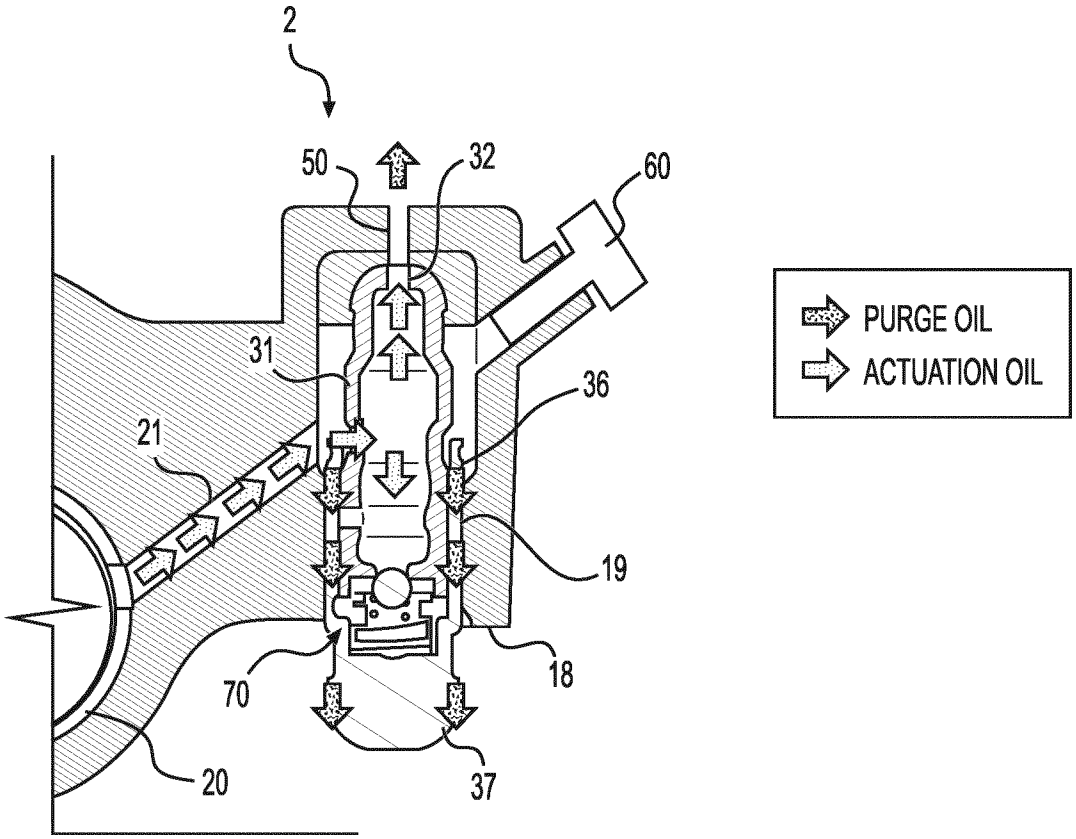

In FIG. 2A, the plug 60 is solid, it does not have a purging hole 61 and blocks path 22. Lash oil instead purges out of a purge pathway shown in the top of FIG. 2B. Lash oil exits through purge ports 32, 42, 50 in plunger 31, plunger cup body 41, and socket end 17. A second purge pathway is shown in FIG. 2B, between inner diameter 19 of HLA bore 15 and HLA body 36. So, actuation oil can fill a low pressure chamber with a reservoir volume RV of oil and can "top off" the oil contained in the HLA bore 15 and contained inside the plunger 31, 311. The actuation oil can be continuously supplied. Then, during actuation, when the ball of the lash assembly 70 moves, the swept volume SV in the high pressure chamber can be exposed to the low pressure reservoir volume RV. Some of the actuation oil becomes purge oil by purging out as shown. The purge oil can lubricate the ball-type spherical ends 39, 391, 37, 371 of the HLA and can lubricate the push tube interface with the valve stem 90. Channels can be formed in either or both of inner diameter 19, 191 and HLA body 36, 361 to form the second purge pathway. Purged lash oil can be used to lubricate the rocker arm assemblies 1-4, including the ball-and-socket style interface of the plunger end 37, 371 in valve stem end 91 of valve stem 90. Or, a ball and socket arrangement can be used so that the plunger 311 comprises a rounded or spherical end 39, 391 and the plunger cup 40, 45 comprises a corresponding socket. The contact between the spherical end 39, 391 and the socket can seal lash oil to exit a purging pathway instead of exiting out another purge pathway, such as an oil gallery.

Figure 3:
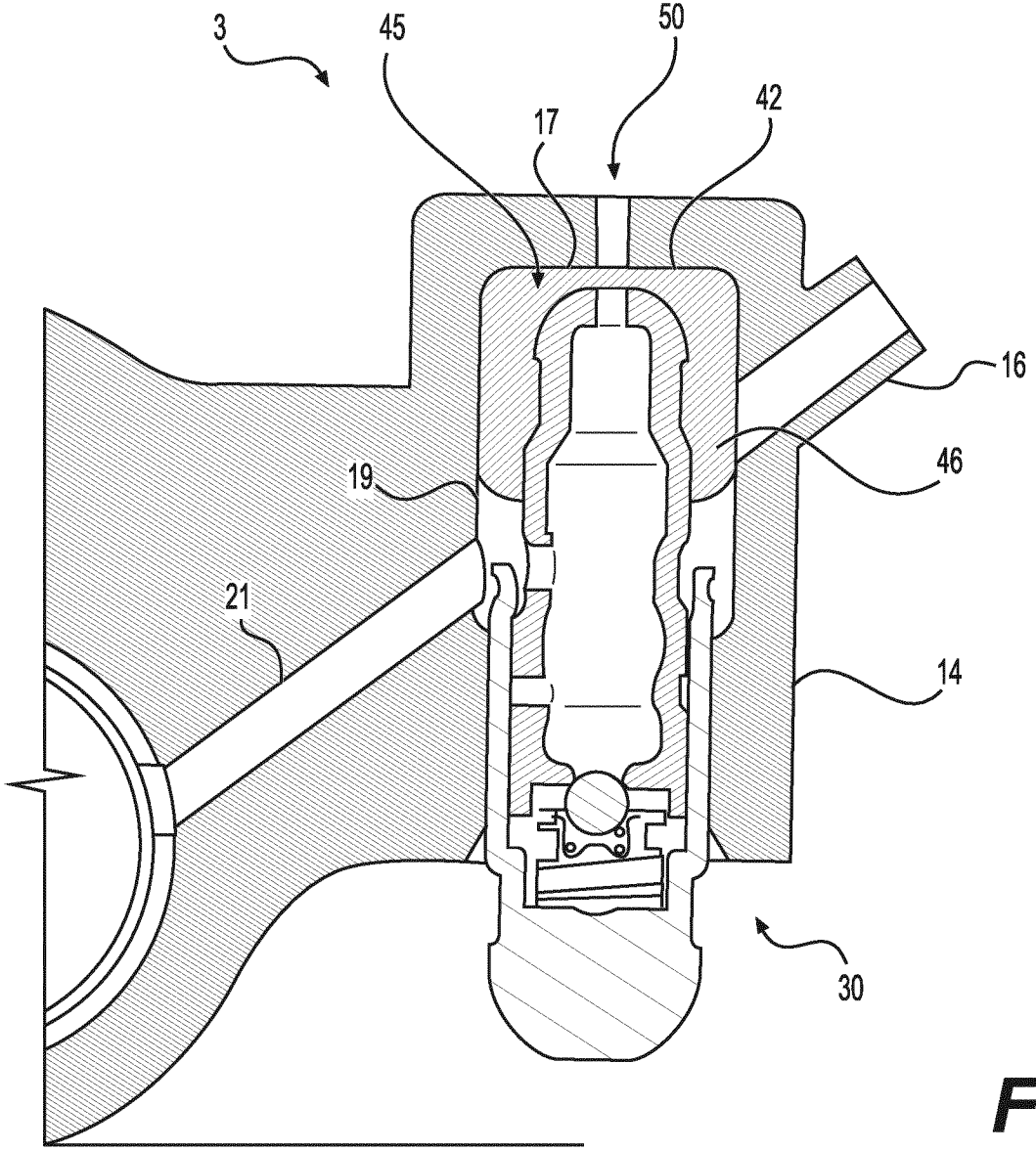
FIG. 3 is a view of a third rocker arm assembly.

The plunger cup 45 of FIG. 3 can have an extended plunger cup body 41. The plunger cup body 41 can have a length that can be varied for the application. An edge 46 of the plunger cup body 41 can extend to block the path 22. Then, plug 60 can be omitted, thereby reducing part count. When made of a light weight material, plunger cup 45 can provide stability to the HLA 30 and reduced weight for the overall rocker arm assembly 3. The HLA bore 15 can be made somewhat larger at inner diameter 19, and with the rocker arm 10 made of a heavier material such as metal, the rocker arm 10 can be heavier than the plunger cup 45. The light weight plunger cup 45 is inserted as a lightweighting measure over the valve. By way of designer choice, it is possible to block purge port 50 by selecting a plunger cup 45 designed to do so. Now, the same rocker arm 10 can be a stock part, with purge pathways and HLA 30 seating position customized via the plunger cup 40, 45 selection with or without a purge port 32, 321 and with or without an extended edge 46 on the plunger cup body 41.

The material of the plunger cup 40, 45 can be chosen to balance weight. It can be desired to select a light material at the valve end 14. Or, it could be desired to add weight over the valve. So, the amount of material in the plunger cup 40, 45 and the type of material can be selected for weight balancing. Plunger cup 40, 45 can be made of an elastomer, plastic, polymer, or metal, for example. The material for the plunger cup 40, 45 can differ from that used in the rocker arm 10.

In an alternative, the rocker arm 10 is formed with an end socket profile 172 in the socket end 171 of the HLA bore 151 of valve end 141. By machining the depth of the end socket profile 172 relative to the socket end 171, the depth of the HLA 30, 301 in the HLA bore 151 can be controlled. Like the customizable plunger cups 40, 45 above, there is an ability to use the same rocker arm 10 in different valvetrains and cylinder head arrangements as a depth of the HLA 30, 301 can accommodate for some variation in valve stem length and other operating parameters. Path 212 can purge lash oil, or a plug 60 can be included with or without a purging hole 61. A purge pathway can be achieved between purge port 32, 321 and end socket profile 172.

Figure 4:
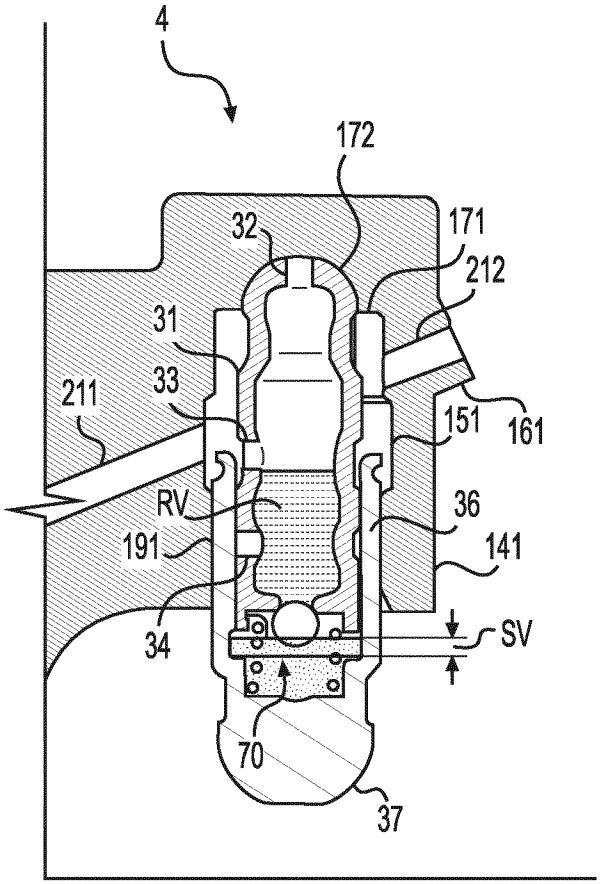
FIG. 4 is a view of a fourth rocker arm assembly.
Figure 5:
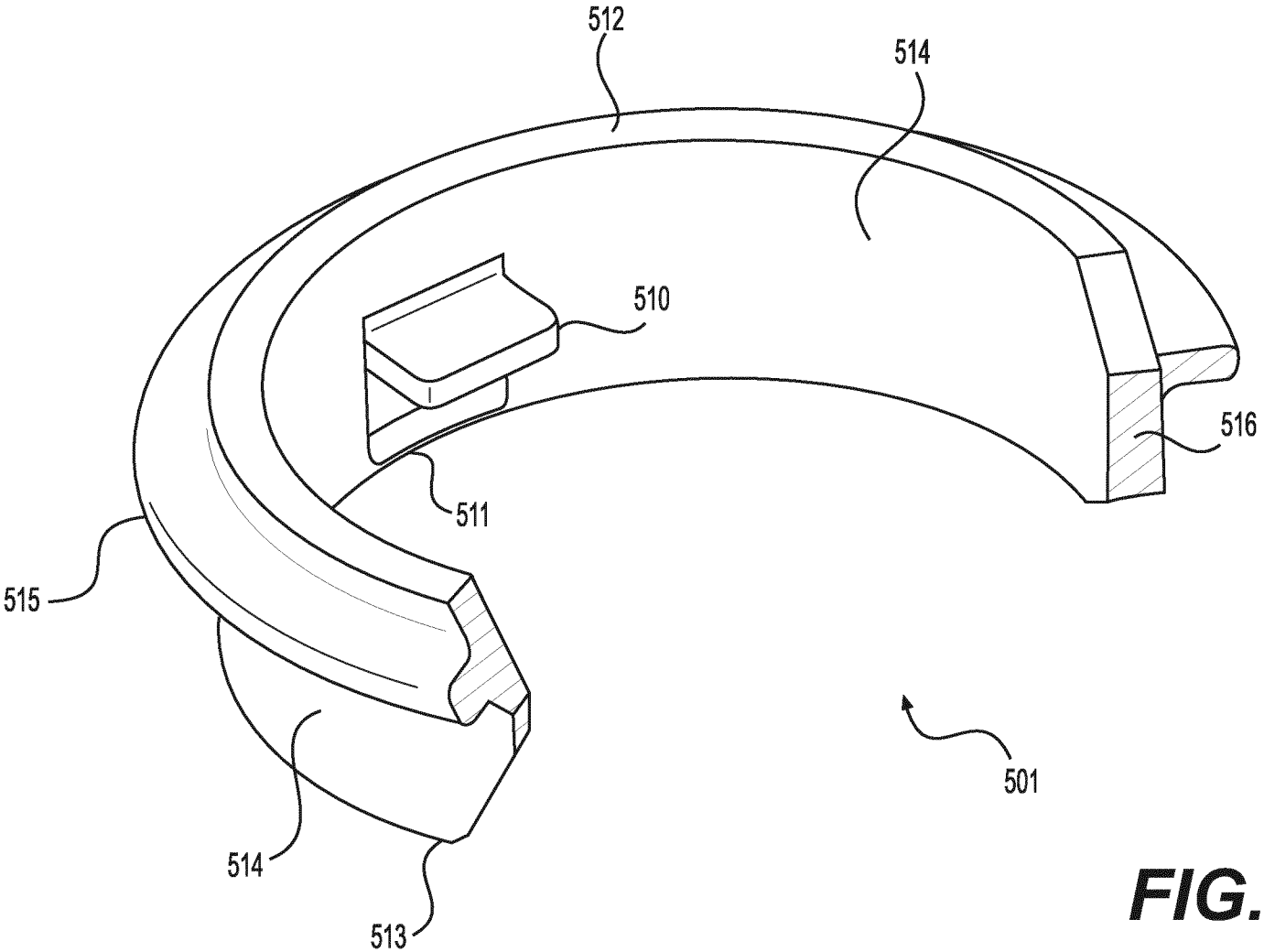
FIG. 5 is a view of a retainer clip.

FIG. 4 also shows aspects of a reservoir volume RV and a swept volume SV that is applicable to the HLAs shown in rocker arm assemblies 1-4. The plunger 31, 301 can comprise a low pressure chamber while the HLA body can comprise the high pressure chamber. The HLA 30, 301 can be shipped with a quantity of lash oil pre-installed. Then, during start-up, the HLA will not be spongy. Plunger 31, 311 can comprise a hollow cavity connected to purge port 32. A supply port 33, 331 is aligned with supply path 21, 211 to top off the HLA 30, 301. Reservoir volume RV of lash oil can fill the cavity to the supply port 33, 331. A second purge port 34, 341 can be included in the plunger 31, 311 but the second purge port 34, 341 can be staunched by the HLA body 36, 361.

A lash assembly 70 is assembled within the HLA 30, 301. Lash assembly 70 can comprise a check, such as a ball. A cage can be included around the check. A biasing member such as a spring can press the check directly or press the cage, when included. Lash assembly can be positioned relative to a lash bore 38, 381. A shoulder 35 in plunger 31 can oppose the lash bore 38, 381, and the check can be biased to seat against the shoulder 35. Plunger 31, 311 has a rim, and HLA body has a step in the inner diameter. Lash can be maintained in a valvetrain by setting a gap between the rim and the step. The swept volume SV of lash oil is within this gap. The HLA 30, 301 can be shipped with the lash bore 38, 381 and gap filled with lash oil and the cavity of the plunger filled as above. At start-up, the HLA 30, 301 is not spongy because the high pressure chamber and low pressure chamber are sufficiently filled with lash oil. At start-up, and during operation, lash oil can be supplied along supply path 21, 211. The lash oil can top off the cavity, filling the HLA to the purge port 32, 321. By following the purge pathways, purge oil can be purged as above, even exiting through second purge port 34, 341 as the HLA 30, 301 is acted on in the valvetrain.

It is possible to form the HLA 30, 301 with two spherical ends 39, 391 and 37, 371 along the main axis of HLA. Several benefits inure. The plunger 31, 311 can be cold formed or roll formed with or without hardening. This is an advantageous manufacturing technique because the plunger 31, 311 can be a single piece of a single material. Other HLA plungers are multiple pieces pressed together or machined pieces with many machining steps. But, this plunger can be an integrally-formed one-piece material with significantly fewer manufacturing steps. The spherical end 39, 391 makes it possible to assemble the HLA with a ball-and-socket type coupling within the HLA bore 15, 151. The HLA 30, 301 is not as sensitive to contact pressures and can tolerate some jiggle.

The HLA body 36 also has an integrally formed spherical end 37, 371 for coupling to a valve stem end 91. Other ball-and-socket arrangements, such as elephant-foot (e-foot) couplings can be used. By using the HLA with two spherical ends 39, 391 & 37, 371 the rocker arm assemblies 1-4 are more tolerant of shifting forces during rocking of the rocker arm 10.

As another improvement, a retainer clip 501 is shown in HLA 301. The retainer clip 501 can be a metal or nonmetal, and it can be forged, stamped, or cold drawn, for example. The retainer clip 501 can be installed with the HLA 301. Unlike the other HLA 30, which can comprise a circlip or other anti-pump-up retainer removed before installation, the retainer clip 501 remains installed after the HLA 301 is installed in the HLA bore 15, 151. The retainer clip comprises a semi-cylindrical clip body 514 with an upper end 512, a lower end 513 and cusps 516. The clip body 514 can also be described as an arc shape. Cusps 516 can be the tips of the arc. Cusps 516 can be designed to slide around the plunger 311, as by pressing or snapping in place. The cusps 516 do not have to wrap all the way around the plunger 311, as shown, or the cusps 516 can be designed with a greater or lesser extent to wrap partially or completely around the plunger 311. An internal nose 510 can be an internally projecting nose that projects into supply port 331. An efficiency of manufacture could comprise stamping the nose 510 from the clip body 514 and bending the nose 510 to position, forming a window 511. This integrally-formed, one-piece configuration is preferred. A forging, stamping, or cold-drawing method could be used to form the retainer clip 501. Though, a cleat or other attachment could be used to form nose 510.

In line with a one-piece configuration, it is possible to form an external protrusion such as rim 515. Rim can seat in an internal groove 362 in HLA body 361. Lower end 513 could be sandwiched between an outer diameter of the plunger 311 and an inner diameter of the HLA body 361, yielding good stability for the retainer clip 501.

Figure 2C:
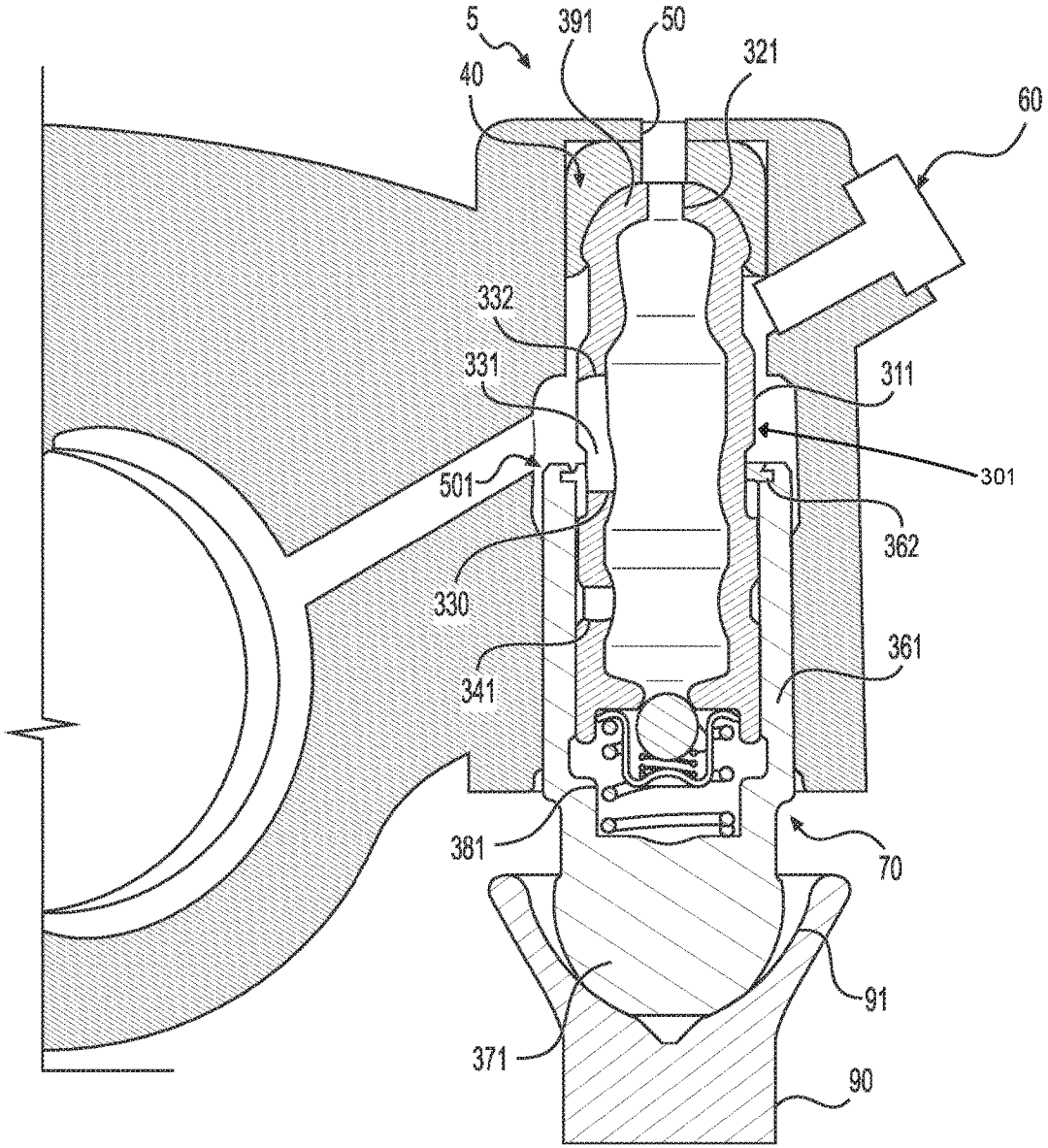

Now, the HLA body 361 is biased away from the plunger 311 by the biasing member of the lash assembly 70. This pushes a first extrema 330 of supply port 331 against the nose 510. Pump down and sponginess of the HLA 301 is prevented because the plunger 311 is locked with respect to the HLA body 361. By sizing the supply port 331, supply port 331 can control travel of the HLA body 361 relative to the plunger 311. A small supply port, like one shown in FIG. 1 could be used. Or a larger supply port 331 can be used. FIG. 2C shows that the supply port 331 comprises a second extrema 332 spaced from the first extrema 330. The HLA body 361 cannot travel past the point where the nose 510 engages with the second extrema 332.

For the HLA 30, it is possible to use a circlip or other anti-pump-up retainer at the interface of the HLA body 36 and rocker arm 10, such as at the opening 18 of HLA bore 15. Such circlip or other retainer can be removed after the rocker arm 10 is placed relative to the valve stem end 91.

Other implementations will be apparent to those skilled in the art from consideration of the specification and practice of the examples disclosed herein.

What is claimed is:

1. A rocker arm, comprising:

a rocker arm body comprising a force-receiving end, a valve end, and a rocker shaft bore, an extension connecting the rocker shaft bore to the valve end;

a hydraulic lash adjuster bore provided in the valve end and comprising a socket end opposite a valve-side opening; and a plunger cup or an end socket profile disposed at the socket end and configured for receiving a convex spherical end disposed on a plunger of a hydraulic lash adjuster.

2. The rocker arm of claim 1, wherein the plunger cup or the end socket profile comprises a concave shape to receive the convex spherical end of the plunger.

3. The rocker arm of claim 1, wherein, when the rocker arm comprises the plunger cup, the plunger cup comprises a purging hole aligned with the plunger.

4. The rocker arm of claim 1, further comprising a fluid pathway from the rocker shaft bore, through the hydraulic lash adjuster bore, and out of the valve end of the rocker arm.

5. The rocker arm of claim 4, wherein, when the rocker arm comprises the plunger cup, the plunger cup is sized so as to block the fluid pathway out of the valve end of the rocker arm.

6. The rocker arm of claim 1, further comprising the hydraulic lash adjuster, wherein the hydraulic lash adjuster comprises, in addition to the convex spherical end disposed on the plunger, a second convex spherical end on a hydraulic lash adjuster body configured to seat against a valve stem end or an elephant foot, the hydraulic lash adjuster body cupping the plunger.

7. The rocker arm of claim 6, wherein the plunger is cold formed or roll formed to form a one-piece plunger.

8. The rocker arm of claim 6, further comprising:

a lash assembly seated to bias the hydraulic lash adjuster body away from the plunger; and a circlip or retainer clip configured to restrict travel of the hydraulic lash adjuster body.

9. A rocker arm, comprising:

a rocker arm body comprising a force-receiving end, a valve end, and a rocker shaft bore, an extension connecting the rocker shaft bore to the valve end;

a hydraulic lash adjuster bore in the valve end, comprising:

a hydraulic lash adjuster body comprising an internal groove;

a plunger comprising a supply port; and a circlip or a retainer clip seated in the internal groove and in the supply port.

10. The rocker arm of claim 9, comprising a reservoir volume of lash fluid in a cavity of the plunger, and a swept volume of lash fluid in the hydraulic lash adjuster body.

11. The rocker arm of claim 9, wherein, when the rocker arm comprises the retainer clip, the retainer clip comprises an arcuate clip body, an exterior extension in the internal groove, and an internally-projecting nose seated in the supply port.

12. The rocker arm of claim 1, further comprising the hydraulic lash adjuster, wherein the hydraulic lash adjuster comprises:

a plunger comprising a supply port, the plunger seated against the plunger cup or the end socket profile;

a hydraulic lash adjuster body cupping the plunger and comprising an internal groove;

a lash assembly seated to bias the hydraulic lash adjuster body away from the plunger; and a retainer clip seated in the internal groove and in the supply port and configured to restrict travel of the hydraulic lash adjuster body relative to the plunger.

13. The rocker arm of claim 12, wherein the retainer clip comprises an arcuate clip body, an exterior extension in the internal groove, and an internally-projecting nose seated in the supply port.

14. The rocker arm of claim 13, wherein the clip body comprises an upper end and a lower end, and wherein the lower end is sandwiched between the hydraulic lash adjuster body and the plunger.

15. A hydraulic lash adjuster, comprising:

a plunger comprising a lash oil supply port;

a hydraulic lash adjuster body cupping the plunger and comprising an internal groove;

a lash assembly seated to bias the hydraulic lash adjuster body away from the plunger; and a retainer clip seated in the internal groove and in the supply port and configured to restrict travel of the hydraulic lash adjuster body relative to the plunger.

16. The hydraulic lash adjuster of claim 15, wherein Mena clip body comprises an upper end and a lower end, and wherein the lower end is sandwiched between the hydraulic lash adjuster body and the plunger.

* * * * *